US006309197B1

(12) United States Patent
Bush et al.

(10) Patent No.: US 6,309,197 B1
(45) Date of Patent: Oct. 30, 2001

(54) SCROLL COMPRESSOR WITH AXIALLY FLOATING NON-ORBITING SCROLL AND NO SEPARATOR PLATE

(75) Inventors: James W. Bush, Skaneateles, NY (US); Zili Sun; Carlos Zamudio, both of Arkadelphia, AR (US); Jason Hugenroth, Hope, AR (US); Greg Hahn; Thomas Barito, both of Arkadelphia, AR (US); Joe T. Hill; John R. Williams, both of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/596,104

(22) Filed: Jun. 16, 2000

(51) Int. Cl.[7] ..... F04C 18/04; F04C 27/00
(52) U.S. Cl. ..... 418/55.4; 418/55.5
(58) Field of Search ..... 418/55.4, 55.5, 418/57

(56) References Cited

U.S. PATENT DOCUMENTS 4,314,796 * 2/1982 Terauchi ..... 418/57
5,482,450 * 1/1996 Caillat et al. ..... 418/55.5

FOREIGN PATENT DOCUMENTS 3-47493 * 2/1991 (JP) ..... 418/55.5
4-5490 * 1/1992 (JP) ..... 418/55.5
4 128580 * 4/1992 (JP) ..... 418/55.5
6-81781 * 3/1994 (JP) ..... 418/55.5

* cited by examiner

*Primary Examiner*—John J. Vrablik
(74) *Attorney, Agent, or Firm*—Carlson, Gaskey & Olds

(57) ABSTRACT

An improved scroll compressor having an axially movable non-orbiting scroll eliminates the need for a separator plate. With the elimination of the separator plate, a back pressure chamber is provided to resist the discharge pressure which will be directed against a rear face of the non-orbiting scroll. In other embodiments, a seal on the rear of the non-orbiting scroll contacts the inner periphery of the end cap. Various ways of increasing the discharge pressure volume, or eliminating undesirable noise are also disclosed. Further, several ways of connecting the end cap to the center shell are also disclosed.

5 Claims, 3 Drawing Sheets

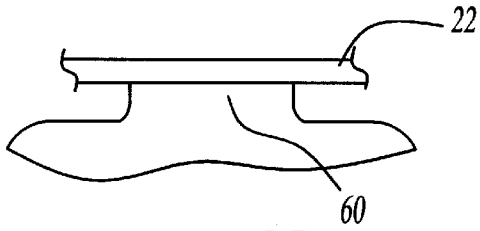
Fig-2B
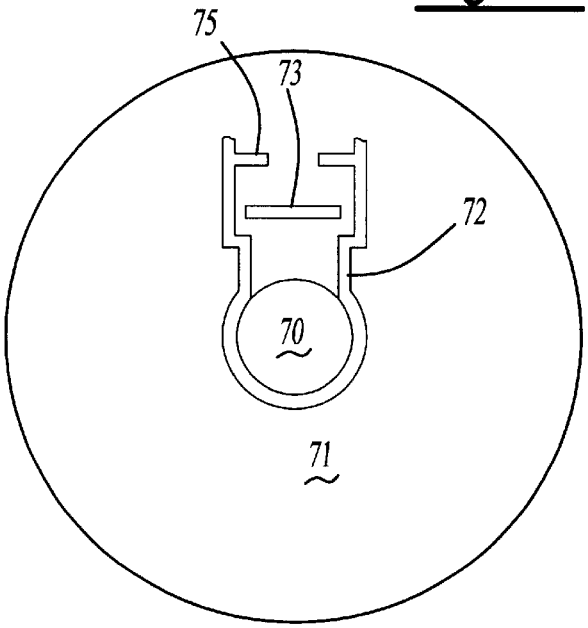
Fig-2C
Fig-2D
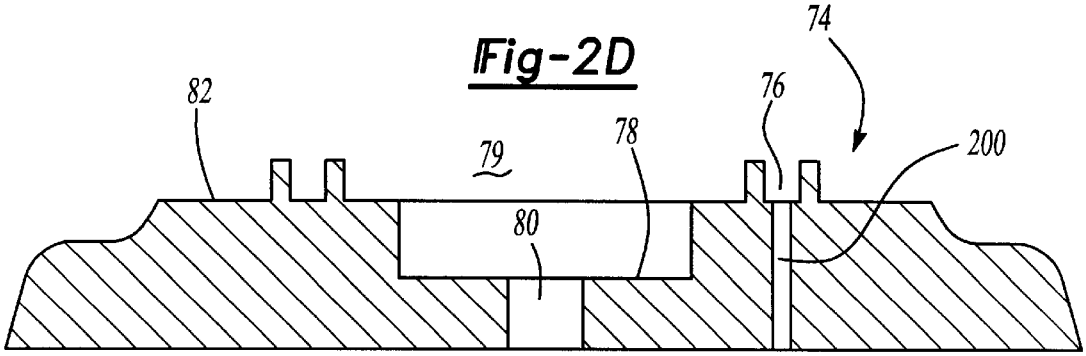
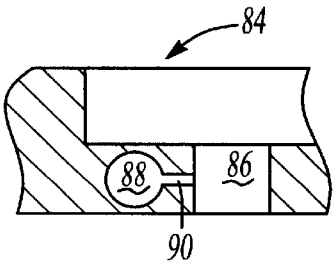
Fig-2E
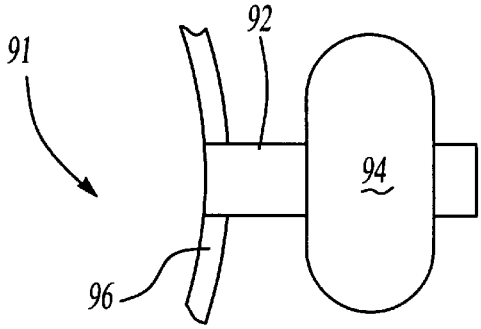
Fig-2F

SCROLL COMPRESSOR WITH AXIALLY FLOATING NON-ORBITING SCROLL AND NO SEPARATOR PLATE

BACKGROUND OF THE INVENTION

This invention relates to a scroll compressor wherein the non-orbiting scroll is of the type that moves axially for a limited distance. In the inventive embodiments, a separator plate which has typically been placed between the base of the non-orbiting scroll and an outer end cap is eliminated.

Scroll compressors are becoming widely utilized in refrigerant compression applications. In a standard scroll compressor, a first scroll has a base and a generally spiral wrap extending from the base. A second scroll has a base and a generally spiral wrap interfitting with the base of the first scroll. A second scroll is driven to orbit relative to the first scroll. Typically, one of the first and second scrolls must move axially to be held in engagement with the other scroll. A refrigerant is entrapped between the wraps of the two scrolls and compressed as the second scroll orbits relative to the first. The entrapped refrigerant creates a force tending to move the two scrolls away from each other. Thus, a portion of the compressed fluid is tapped behind the base of one of the two scrolls to resist this so-called separating force. In one common type of scroll compressor, the first scroll receives the tapped compressed fluid, and is allowed to move for a limited axial distance.

Typically, scroll compressors are enclosed in a sealed compressor housing. In such sealed compressor housings, a center shell receives an end cap which defines a fluid tight chamber. A separator plate defines a discharge pressure chamber. A separator plate defines a discharge pressure chamber on one side and a suction pressure chamber on the other side. Suction pressure fluid is allowed to enter the compressor housing through the center shell, and communicate with an area around a motor, cooling the motor. The separator plate performs the function of separating the interior of the housing into the discharge and suction pressure chambers.

It would be desirable to simplify the number of components in the above discussed scroll compressor.

SUMMARY OF THE INVENTION

In a disclosed embodiment of this invention, an axially movable non-orbiting scroll in a scroll compressor also separates the interior of the housing into the suction and discharge pressure chambers. In this way, the requirement of a separate separator plate is eliminated.

With the elimination of the separate separator plate, the base of the non-orbiting scroll includes a sealing member which seals with an inner surface of an end cap. In one embodiment, the seal defines the suction chamber outwardly of the seal, and a discharge chamber inwardly of the seal. With such an arrangement, the volume of the discharge pressure chamber is reduced compared to the prior art. This might result in increased discharge pressure pulsation. Thus, several modifications are utilized to increase the volume. In one, the end cap is domed outwardly to increase the volume of the discharge pressure chamber radially inwardly of the seal. In other embodiments, while the volume may not be increased, the pressure pulsations from the discharge chamber are reduced through any one of several features. As one example, a torturous path may be provided for the discharge pressure flow. In another embodiment, the base of the discharge pressure chamber may be cut away to increase the volume. In yet another embodiment, a Helmholtz resonator is utilized to lower the magnitude of the discharge pressure pulsation. In other embodiments, a discharge muffler may be mounted outwardly of the housing, thus lowering the necessary volume inside the housing.

In another embodiment of this invention, at least a large portion of the base of the non-orbiting scroll sees the discharge pressure itself on an opposed face from the compression chambers, the separating force is actually no longer merely overcoming the force of the refrigerant. Instead, the discharge pressure applies a force to the non-orbiting scroll member towards the orbiting scroll members at a level exceeding the separating force. Thus, a back pressure chamber is utilized to resist this excess discharge pressure. In a preferred embodiment a portion of the compressed refrigerant is tapped to a chamber defined by a pair of seals within a crankcase. This back pressure chamber resists the force from the discharge pressure chamber, and is combined with the separating force to maintain the orbiting and non-orbiting scroll members in proper position relative to each other.

In other features of this invention, various methods and arrangements for connecting the end cap to the center shell are disclosed. In the past, the separating plate has typically been incorporated into this connection. With the elimination of the separator plate, other structures must be utilized.

These and other features of the present invention can be best understood from the following specification and drawings, the following of which is a brief description.

BRIEF DESCRIPTION OF THE DRAWINGS

FIG. 2B shows a further feature which may modify the FIG. 2*a* embodiment.

FIG. 2C shows yet another embodiment.

FIG. 2D shows yet another embodiment which may modify the FIG. 2A embodiment.

FIG. 2E shows yet another embodiment.

FIG. 2F shows yet another embodiment.

DETAILED DESCRIPTION OF A PREFERRED EMBODIMENT

Figure 1:
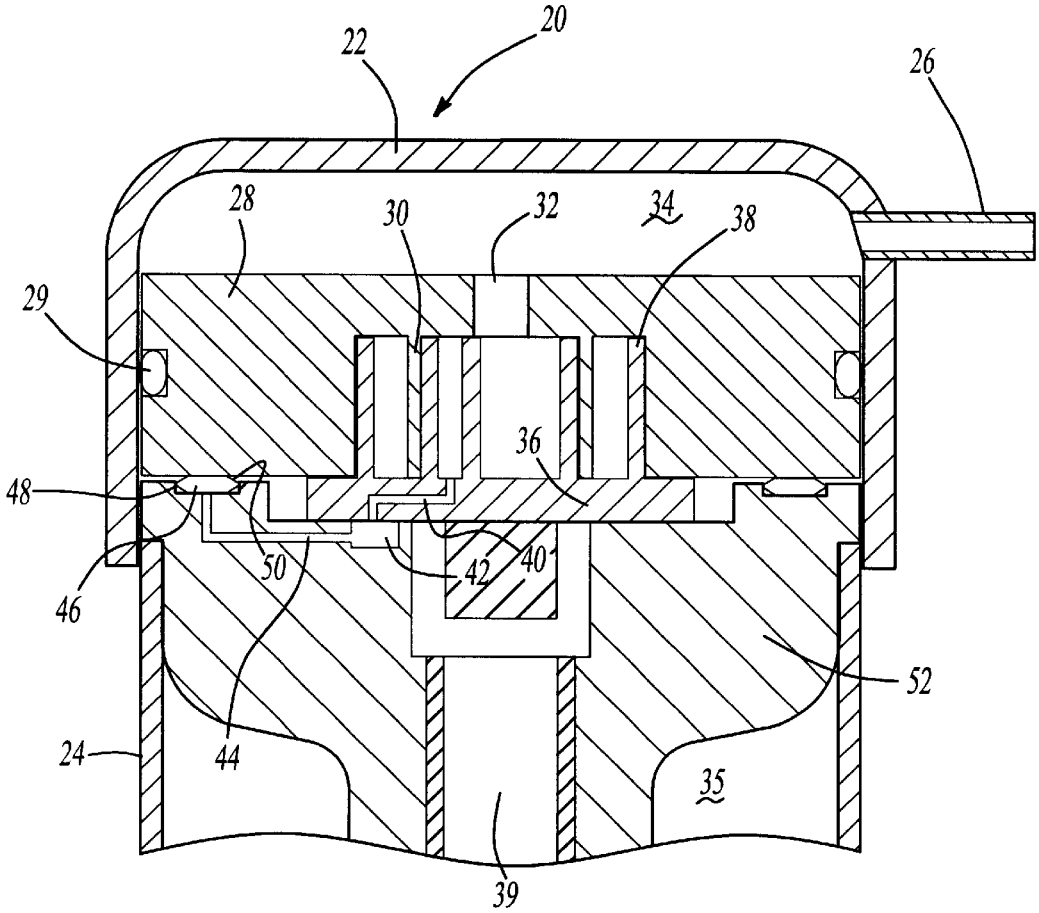
FIG. 1 is a cross-sectional view of an inventive first embodiment of a scroll compressor.

A scroll compressor 20 is illustrated in FIG. 1 having an end cap 22 welded to a center shell 24. A discharge tube 26 extends outwardly of the end cap 22. A non-orbiting scroll 28 is received within the end cap 22, and is of the type which may move through a limited axial distance. Non-orbiting scroll 28 has a wrap 30, and a discharge port 32 leading to a discharge pressure chamber 34. An orbiting scroll 36 has a wrap 38 which interfits with the wrap 30 to define compression chambers. A crankcase 52 mounts scroll 36. A shaft 39 drives the orbiting scroll 36, as known. As shown, with this invention, there is no separator plate separating discharge pressure chamber 34 from the rear of the base of the non-orbiting scroll 28. Thus, the pressure in the discharge pressure chamber 34 acts on the rear face of the non-orbiting scroll base 28. The present invention taps compressed fluid to resist this force.

As shown, a tap 40 leads to a chamber 42 which may be generally cylindrical. Chamber 42 leads to a tap 44, which in turn leads to a back pressure chamber 46. Back pressure chamber 46 is defined by seals 48 and 50. The tapped pressurized refrigerant in chamber 46, in addition to the separating force from the refrigerant trapped in the compression chambers, resist the force from the discharge chamber 34 tending to force the two scroll members together to an undesirable amount. The size and position of the taps leading to the chamber 46 are designed to achieve a proper balance between the forces in the chamber 34 acting on the rear of the non-orbiting scroll 28 and the combined forces acting in opposition to that force.

A seal 29 seals the outer periphery of the non-orbiting scroll 28 in this embodiment. Thus, a chamber 35 on one side of seal 29 is at suction pressure, while the pressure chamber 34 on the opposed side of seal 29 is at discharge pressure. This embodiment reduces the number of components and simplifies the assembly of the scroll compressor.

Figure 2A:
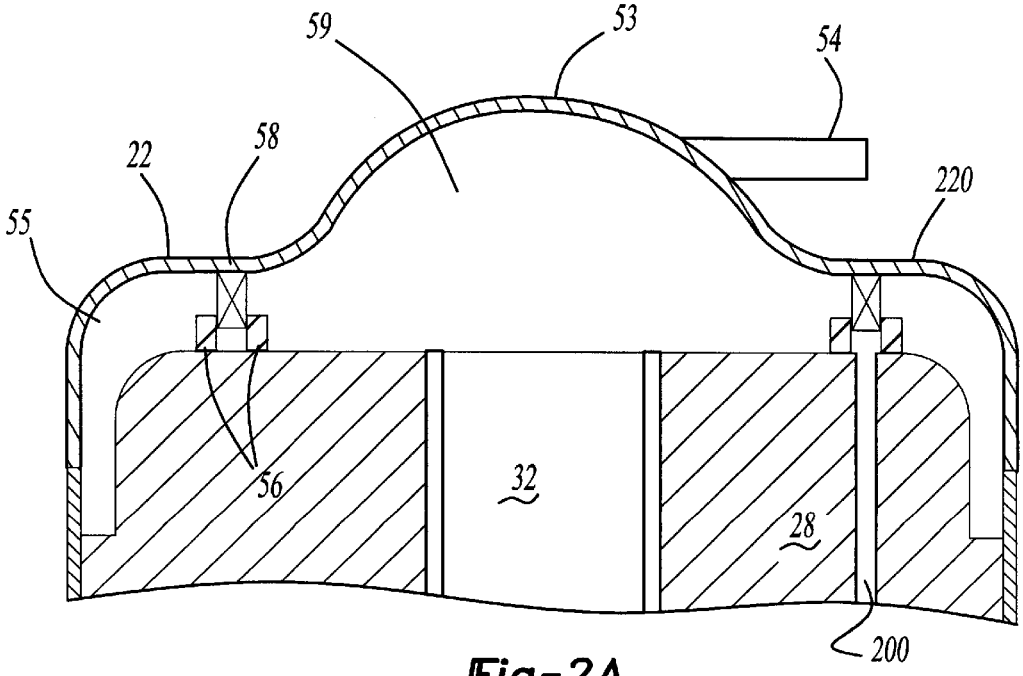
FIG. 2A is a cross-sectional view through another embodiment of the present invention.

FIG. 2A shows another embodiment wherein a dome portion 53 of the end cap 22 is positioned inwardly of seal structures 56 on the base of the non-orbiting scroll 28. A seal member 58 is positioned between seal portions 56. The seal portions are shown somewhat schematically. Any appropriate seal may be utilized. As the non-orbiting scroll 28 is moved within the chamber, the seal 58 ensures that the chamber 59 inwardly of the seal remains at discharge pressure due to its communication with the discharge port 32 while the chamber 55 outwardly of the seal 58 is at suction pressure. A discharge port 54 communicates with the volume 59. With this embodiment, due to the dome, the seal can still easily define the discharge and suction sides of the compressor, while still providing a relatively large volume of discharge gas.

As can be seen, the end cap 22 has portions 220 which are positioned radially outwardly of the seal, and which are generally horizontal. Thus, the central domed portion 53 provides a greater volume.

A tap 200 will tap an intermediate pressure refrigerant to a back pressure chamber defined by the seals 56 and 58. This structure may be basically as known, and is shown schematically in FIG. 2A. This type back pressure chamber is the more typical way of addressing the separating force between the two scroll members, and may actually be preferred over the arrangement of FIG. 1.

FIG. 2B shows another embodiment wherein the seal surface is provided by a metal to metal contact between a seal member 60 on the non-orbiting scroll and the end cap 22.

FIG. 2C shows another way of attending to undesirable noise due to the reduced volume of the discharge pressure chamber. In this embodiment, the discharge port 70 extending through the non-orbiting scroll 71 base leads to a labyrinth flow 72 having facing structure 73 and 75. Thus, the refrigerant must flow through a torturous path, reducing noise in the refrigerant flow.

FIG. 2D shows another embodiment 74 having sealing structure 76 similar to the FIG. 2A seal. An area inwardly of the sealing structure 76 is cut away such as shown at 78. The discharge port 80 extends into the cutaway area 78. In this way, the volume of the discharge pressure chamber 79 is increased compared to an embodiment where the cutaway portion 78 does not exist. Stated another way, the non-orbiting scroll member 74 has the cutaway portion 78 formed to be closer to the orbiting scroll than portions 82 outwardly of the sealing portion 76.

FIG. 2E shows an embodiment 84 having its discharge port 86 leading to a Helmholtz resonator 88. The Helmholtz resonator is connected through a tap 90 to the discharge port 86. As is known, the Helmholtz resonator can be tuned to eliminate specific noises which are to be experienced in the particular compressor at discharge due to the reduced volume of the discharge chamber.

FIG. 2F shows yet another embodiment 91. In embodiment 91, the end cap 96 communicates with a discharge tube 92 which leads to a muffler 94. The muffler 94 is thus positioned outwardly of the sealed housing. In this way, the muffling of the noise occurs outwardly of the housing and the reduced size of the discharge chamber is addressed.

In the prior art, the separator plate was also typically part of the structure between the several housing members. Thus, alternative ways of connecting the end cap to the center shell must be developed due to the elimination of the separator plate.

Figure 3A:
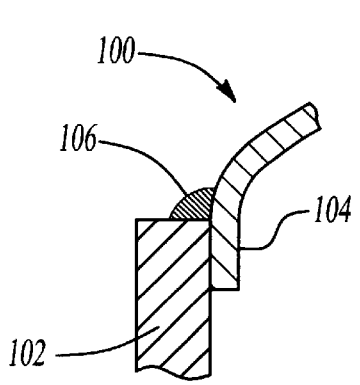
FIG. 3A shows a first housing connection.

As shown in FIG. 3A, an embodiment 100 includes a center shell 102 having an end cap 104 which extends inwardly of the center shell 102 and receives a weld joint 106.

Figure 3B:
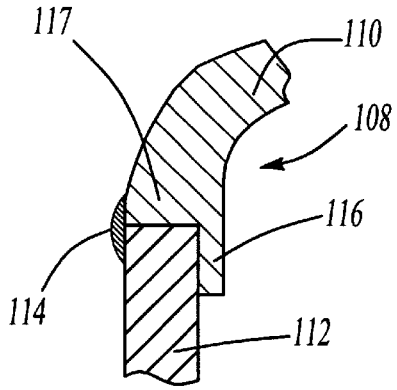
FIG. 3B shows a second housing connection.

FIG. 3B shows an embodiment 108 wherein the end cap 110 is mounted on the center shell 112 and receives a weld joint 114. The end cap 110 has a finger 116 extending downwardly at a position radially inwardly of the center shell, and another portion 117 facing an upper portion of the center shell 112.

Figure 3C:
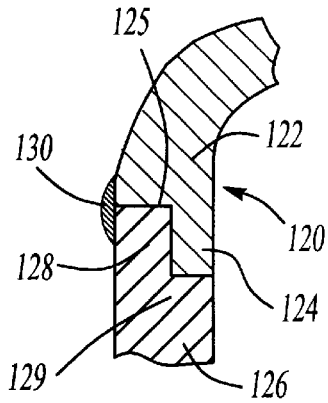
FIG. 3C shows a third housing connection.

FIG. 3C shows an embodiment 120 wherein the end cap 122 has finger 124 and an end portion 125 facing a center shell 126 having portions 128 and 129. Again, a weld joint 130 secures the two.

In general, the discharge pressure chamber could be described as being defined between a base of the non-orbiting scroll and the end cap of the housing, along with being also defined by a sealing element between the non-orbiting scroll and either the end cap or the center shell. Further, the discharge pressure chamber could be defined by a cross-sectional are on the rear of the base of the non-orbiting scroll which is relatively close in size to the cross-sectional area of a plane normal to an axis of rotation of the shaft 39, over which the discharge pressure chamber is defined on the end cap.

The present invention thus defines scroll compressors wherein the non-orbiting scroll is axially movable, and wherein the separator plate is eliminated. A worker of ordinary skill in this art would recognize that many modifications would come within the scope of this invention. Thus, the following claims should be studied to determine the true scope and content of this invention.

What is claimed is:

1. A scroll compressor comprising:

a first scroll having a base and a generally spiral wrap extending from said base;

a second scroll having a base and a generally spiral wrap extending from said base;

a shaft for causing said second scroll to orbit relative to said first scroll, said first scroll being operable to move axially along a rotational axis of said shaft relative to said second scroll;

said first and second scrolls and said shaft being mounted within a sealed housing, said sealed housing including a center shell and an end cap enclosing said center shell, a refrigerant trapped between said wraps of said first and second scrolls being compressed and delivered through a discharge port extending through said base of said first scroll into a discharge pressure chamber, said discharge pressure chamber being defined between a face of said base of said first scroll and said end cap; and a seal being formed between a face of said first scroll which faces said end cap and said end cap, said seal being attached to one of said end cap and said first scroll, and between two seal portions on the other, a sliding interface defined between said seal and said two seal portions.

2. A scroll compressor as recited in claim 1, wherein said seal is fixed to said end cap, and said seal portions are movable with said first scroll member on each circumferential side of said seal.

3. A scroll compressor as recited in claim 1, wherein said seal defines a discharge pressure chamber radially inwardly of said seal and a suction pressure chamber radially outwardly of said seal.

4. A scroll compressor a recited in claim 3, wherein said end cap is generally horizontal radially outward of said seal, and having a domed area extending axially outwardly away from said base of said first scroll radially inwardly of said seal to define an enlarged discharge pressure chamber.

5. A scroll compressor comprising:

a first scroll having a base and a generally spiral wrap extending from said base;

a second scroll having a base and a generally spiral wrap extending from said base;

a shaft for causing said second scroll to orbit relative to said first scroll, said first scroll being operable to move axially along a rotational axis of said shaft relative to said second scroll;

said first and second scrolls and said shaft being mounted within a sealed housing, said sealed housing including a center shell and an end cap enclosing said center shell, a refrigerant trapped between said wraps of said first and second scrolls being compressed and delivered through a discharge port extending through said base of said first scroll into a discharge pressure chamber, said discharge pressure chamber being defined between a face of said base of said first scroll and said end cap, a seal being formed between a face of said first scroll which faces said end cap and said end cap; and said seal defining a discharge pressure chamber radially inwardly of said seal and a suction pressure chamber radially outwardly of said seal, said end cap being generally horizontal radially outward of said seal, and having a domed area extending axially outwardly away from said base of said first scroll radially inwardly of said seal to define an enlarged discharge pressure chamber.

* * * * *